US005668509A

United States Patent [19]

Hoffmeister et al.

[11] Patent Number: 5,668,509

[45] Date of Patent: Sep. 16, 1997

[54] MODIFIED COAXIAL TO GCPW VERTICAL SOLDERLESS INTERCONNECTS FOR STACK MIC ASSEMBLIES

[75] Inventors: Richard M. Hoffmeister, Torrance; Clifton Quan, Arcadia, both of Calif.

[73] Assignee: Hughes Electronics, Los Angeles, Calif.

[21] Appl. No.: 621,565

[22] Filed: Mar. 25, 1996

[51] Int. Cl.[6] ..... H01P 5/00

[52] U.S. Cl. ..... 333/33; 333/260

[58] Field of Search ..... 333/33, 246, 260; 439/63, 66, 578, 582

[56] References Cited

U.S. PATENT DOCUMENTS

| | | | |
|---|---|---|---|
| 5,302,923 | 4/1994 | Mason et al. | 333/260 X |
| 5,477,160 | 12/1995 | Love | 439/66 X |
| 5,552,752 | 9/1996 | Sturdivant et al. | 333/246 X |

OTHER PUBLICATIONS

"Array Module Connector Test Program At Unisys," R.J. Kuntz, S. Williams, MCM '94 Proceedings, pp. 498–503.

"CIN::APSE Standard Products," Cinch Connector Division.

"A Modified PTFE Microwave Circuit Substrate," R.J. Bonfield, MSN & Communications Technology, Feb. 1988.

*Primary Examiner*—Paul Gensler

*Attorney, Agent, or Firm*—Leonard A. Alkov; Wanda K. Denson-Low

[57] ABSTRACT

A vertical, right angle transition to a GCPW transmission line using a modified coaxial transmission line. The solderless interconnect provides a transition from a GCPW in a horizontal plane to a vertical plane. The modified coaxial line has a portion of the outer shield removed from the front, and is placed vertically on the center conductor of a GCPW. The coaxial shield connects both ground planes of the GCPW. The transition can be employed to form an interconnect between a stacked assembly of microwave hybrids.

21 Claims, 5 Drawing Sheets

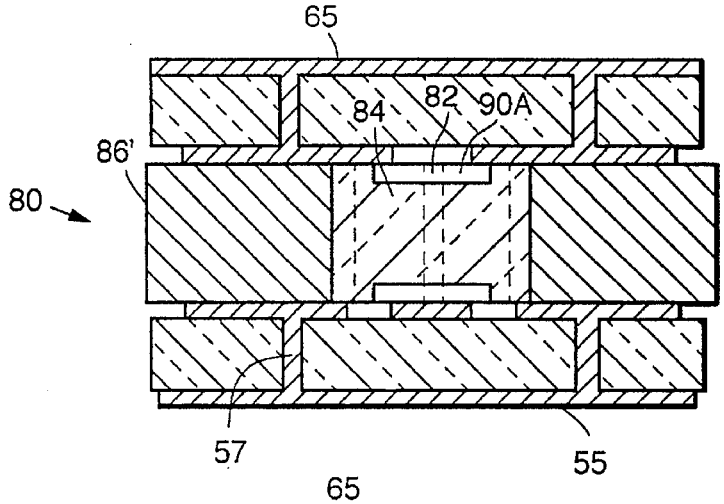
FIG.8
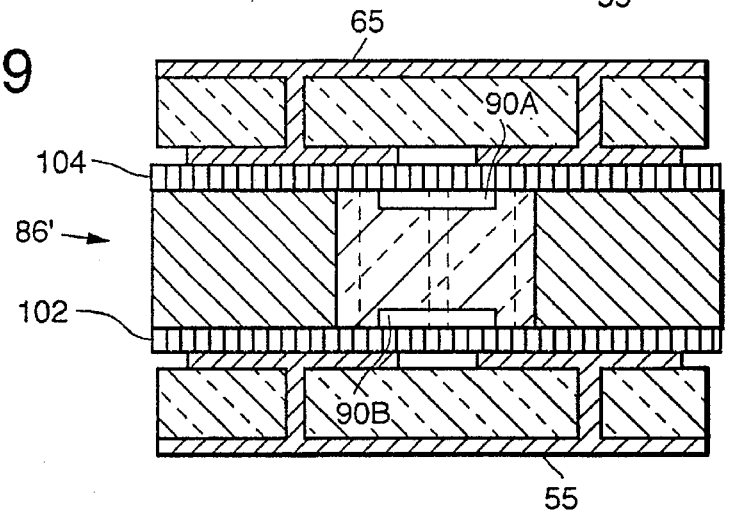
FIG. 9
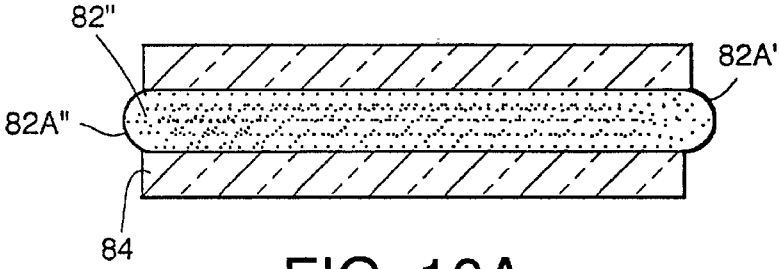
FIG. 10A
FIG. 10B
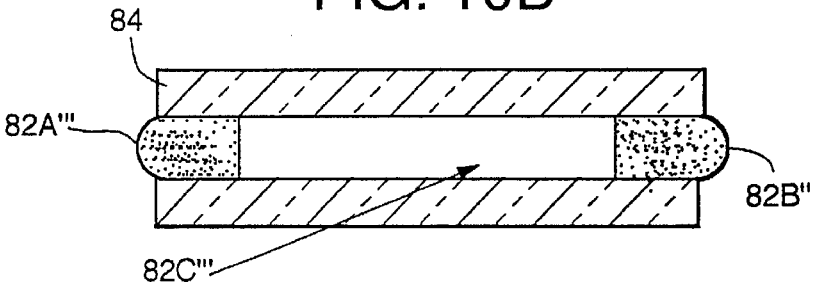

MODIFIED COAXIAL TO GCPW VERTICAL SOLDERLESS INTERCONNECTS FOR STACK MIC ASSEMBLIES

CROSS REFERENCE TO RELATED APPLICATION

Reference is made to U.S. Pat. No. 5,552,752, "Microwave Vertical Interconnect Trough Circuit With Compressible Conductor," which was copending at the time this application was filed.

TECHNICAL FIELD OF THE INVENTION

This invention relates to microwave circuit packaging, and more particularly to a technique for providing vertical solderless right angle transitions between a Grounded Coplanar Waveguide (GCPW) using a modified coaxial transmission line.

BACKGROUND OF THE INVENTION

There is a need in many microwave applications for providing RF interconnections between adjacent circuit boards. Conventional techniques for interconnecting circuit boards include the use of cables. The disadvantages to these methods include increased size, weight, and cost.

This invention offers a new, compact approach to microwave packaging. Separate, individual hybrids and RF electronic subsystem assemblies can now be packaged vertically, saving valuable real estate. Other techniques for providing vertical bends in interconnections require several process steps and a more permanent attachment such as epoxies and solders.

This invention provides the capability to create low cost, easy to assemble and easy to repair multi-layered stacked microwave hybrid assemblies. Other transmission interconnects require a more permanent attachment such as solders and epoxies and have narrower operating frequency bandwidth.

SUMMARY OF THE INVENTION

According to one aspect of the invention, a right angle transition for GCPW transmission line is described, and comprises a dielectric substrate with a GCPW line. A center conductor strip and opposed finite ground conductor strips are formed on a first substrate surface, and a conductive ground plane is formed on a second substrate surface. A modified coaxial connector structure includes a center conductor pin, a dielectric support element surrounding the pin, and outer conductive shielding surrounding a portion of a periphery of the dielectric support element. An area of the periphery of the dielectric structure is free of conductive shielding. The connector structure is disposed transversely to the GCPW center conductor strip such that an end of the coaxial center pin is in contact with the center conductor strip, and the coaxial outer shielding is in contact with the first and second finite ground strips. The shielding does not contact the center conductor strip due to the area of the periphery being free of shielding, and so the shielding provides a ground return between the coaxial connector structure and the GCPW line without shorting the GCPW center conductor strip.

A layer of anisotropically conductive elastomer material can be placed between the modified coaxial connector structure and the GCPW strips. Since the material is conductive only in the direction normal to the surface of the substrate, the center conductor strip remains electrically isolated from the coaxial outer shielding.

The transition can be employed to interconnect two stacked substrate boards each carrying GCPW lines.

BRIEF DESCRIPTION OF THE DRAWING

These and other features and advantages of the present invention will become more apparent from the following detailed description of an exemplary embodiment thereof, as illustrated in the accompanying drawings, in which:

FIG. 8 is a cross-sectional view of an alternative embodiment of a modified coaxial connector in accordance with the invention, wherein the outer coaxial shielding is relieved only at areas at each coaxial end.

FIG. 9 is a cross-sectional view of a further alternate embodiment of a modified coaxial connector in accordance with the invention, wherein the outer coaxial shielding is relieved only at areas at each coaxial end, and employing anisotropically conductive films sandwiched between the connector and GCPW lines.

FIG. 10A illustrates one possible form of a compressible coaxial conductor pin in a bore formed in a dielectric member.

FIG. 10B shows an alternate form of coaxial pin structure, comprising a solid conductor portion and two compressible portions at the extremities of the solid portion.

DETAILED DESCRIPTION OF THE PREFERRED EMBODIMENT

Figure 1:
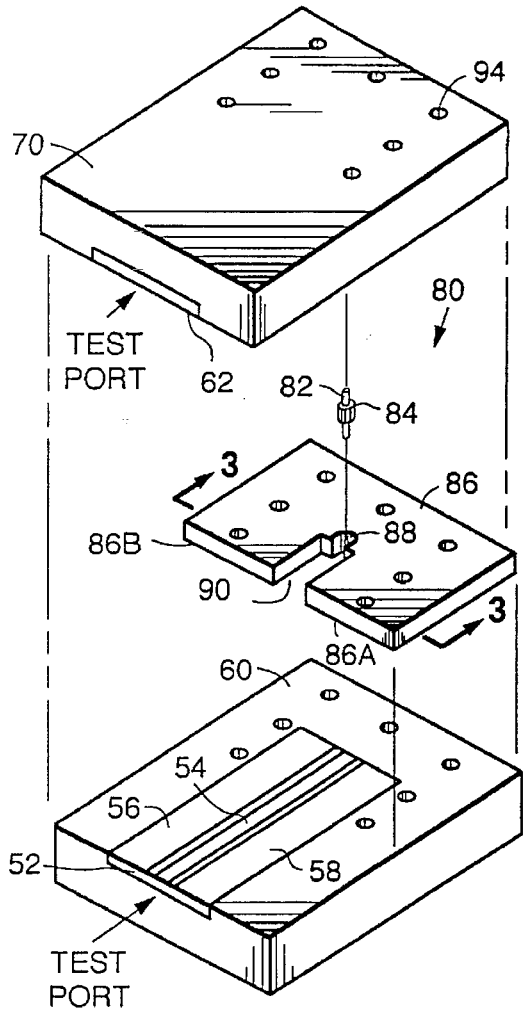
FIG. 1 is an exploded isometric view of a vertical, right angle transition between stacked substrates carrying GCPW transmission lines in accordance with the invention.

One aspect of this invention is a vertical, right angle transition to a GCPW transmission line using a modified coaxial transmission line. This solderless interconnect provides a transition from a GCPW in a horizontal plane to a vertical plane. The modified coaxial line has a portion of the outer shield removed from the front, and is placed vertically on the center conductor of a GCPW. The coaxial shield connects both ground planes of the GCPW. The transition can be employed to form an interconnect between a stacked assembly of microwave hybrids, as shown in FIG. 1. The transition has the advantage of creating a compact transition from a horizontal GCPW to a vertical plane with the modified coaxial line without additional coaxial connector components such as SSMA or SMA connectors. The invention can be employed to form a matched 50 ohm transition between a GCPW and a modified coaxial line without exciting additional parasitic waveguide modes.

FIG. 1 is an exploded isometric view of a vertical, right angle transition between stacked substrates carrying GCPW transmission lines in accordance with the invention. A first dielectric substrate 52 carries on a top surface a first GCPW line comprising a center conductor strip 54 and opposed ground conductor strips 56 and 58. The substrate 52 is supported in a conductive housing 60. A second dielectric substrate 62 carries a second GCPW line not visible in FIG. 1, but also comprising a center conductor strip and opposed ground conductor strips. The substrate 62 is supported in housing 70. The two GCPW lines and their substrates are, when assembled together, in a parallel, spaced configuration.

To provide a vertical interconnection between the first and second GCPW lines, a modified coaxial connector 80 is provided. This connector includes a center conductor pin 82, a dielectric spacer 84, and an outer conductive shield, defined by plate 86. In this embodiment, the pin and dielectric spacer fit into an opening 88 defined in the plate 86. In this example, the opening 88 accepts the cylindrical dielectric spacer 84, such that the dielectric is shielded over about 300 degrees. Plate 86 includes a relieved open area 90 which extends into the opening 88 to remove a portion of the shielding from the front of the coaxial connector 80. The amount of shielding removed will depend on the particular design requirements. It has been found that removing about 60 to about 120 degrees of shielding provides good performance.

The pin 82 is placed vertically on the center conductor 54 of the first GCPW line, and on the center conductor of the second GCPW line. The pin 82 has an exaggerated length to provide fabrication tolerances. The ends of the pin 82 can extend from the respective end surfaces of the dielectric member 84 by 3 to 10 mils, in exemplary applications.

Figure 2A:
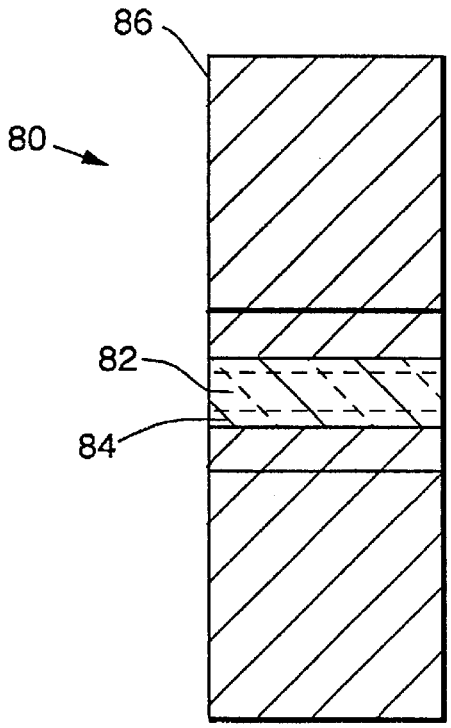
FIG. 2A is an end view of the modified coaxial connector of the transition of FIG. 1.
Figure 2B:
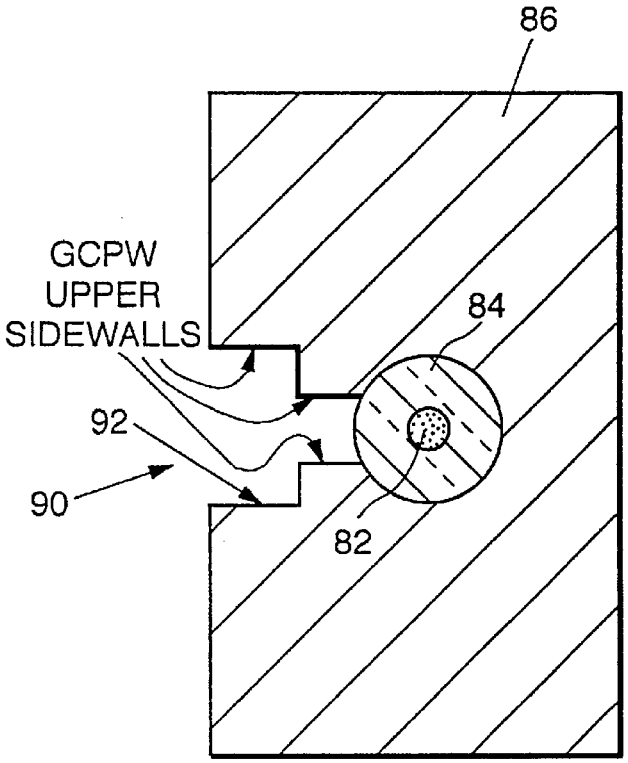
FIG. 2B is a top view of the connector, showing the arrangement of the pin, dielectric spacer and shielding plate.

FIG. 2A is an end view of the modified coaxial connector 80. FIG. 2B is a top view of the connector 80, showing the arrangement of the pin 82, dielectric spacer 84 and plate 86. In this exemplary embodiment, the shielding is removed from about 60 degrees of the total circumference of the connector 80 to prevent short circuiting the GCPW center and ground plane strips when the connector 80 is assembled to the GCPW line. With the modified coaxial connector 80 in place, the open area 90 straddles the center conductor strip of the GCPW.

The lower surface 86A of the metal plate 86 contacts the ground conductor strips 56, 58 of the first GCPW line. The upper surface 86B of the metal plate 86 contacts the ground conductor strips of the second GCPW line carried by housing 70, to provide a continuous ground return between the coaxial connector 80 and the GCPW lines. The two housings 60 and 70 can be assembled to sandwich the plate 86 using fasteners extended through holes 94 (FIG. 1) in the housings. Pressure contact is used to make the electrical interconnection between the two stacked GCPW substrates. Thus, no solder is required to make the transition between two horizontal GCPW lines.

Figure 3B:
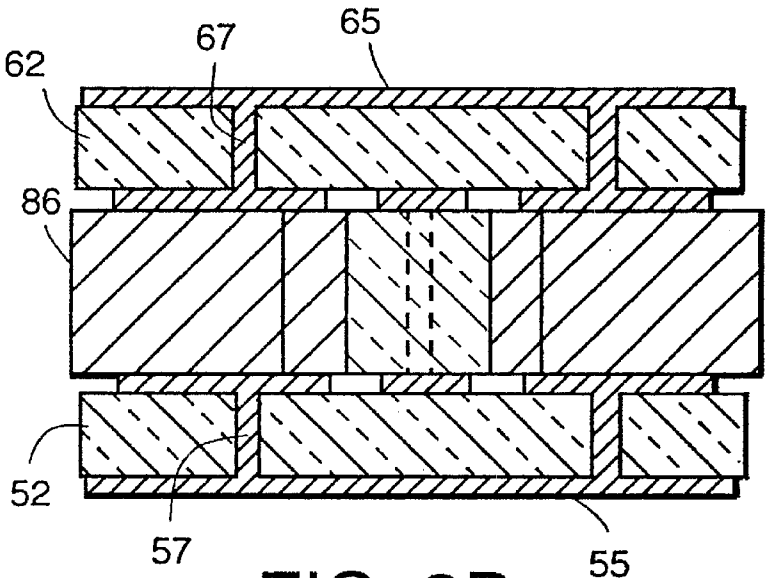
FIG. 3B is a simplified end view of the stacked substrate assembly of FIG. 1, showing the configuration after assembly.
Figure 3A:
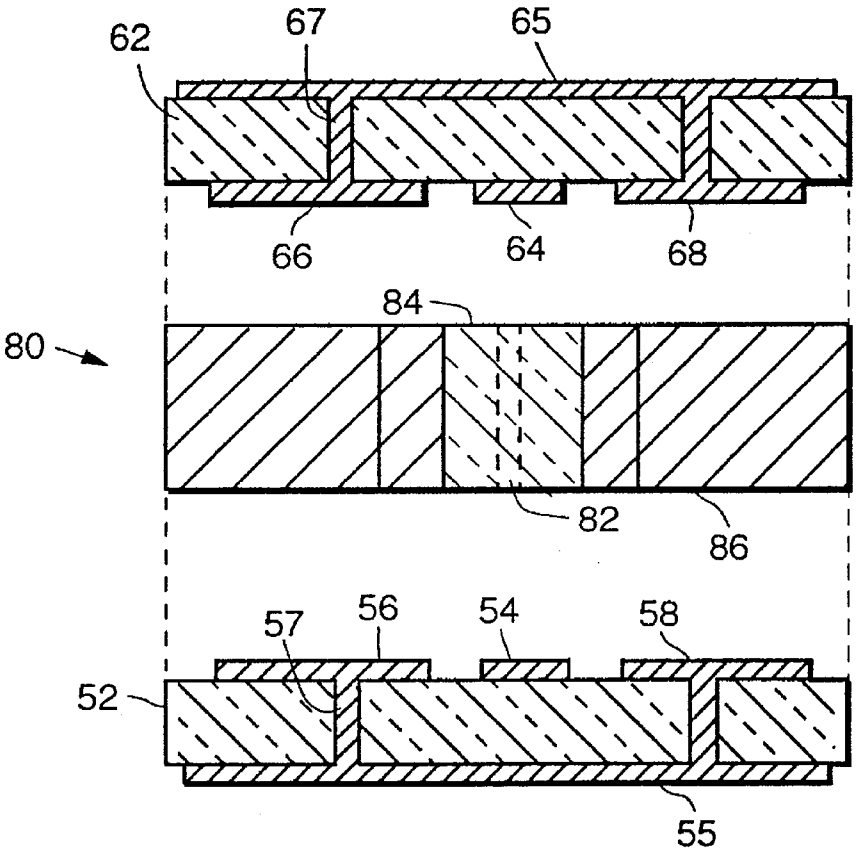
FIG. 3A is a simplified exploded end view of the stacked substrate assembly of FIG. 1, illustrating the substrates and modified coaxial connector prior to assembly.

The assembly is shown in the cross-sectional views of FIGS. 3A and 3B, each generally taken along line 3—3 of FIG. 1, but excluding for simplicity the housings 60 and 70. FIG. 3A is an exploded view, illustrating the positions of the substrates 52 and 62 and coaxial connector 80 prior to assembly. The first GCPW line includes the center conductor strip 54, finite ground plane strips 56 and 58, lower ground plane 55 and conductive ground vias 57 extending through the substrate 52 to electrically connect the upper and lower ground planes. Similarly, the second GCPW line includes the center conductor strip 64, finite ground plane strips 66 and 68, an upper surface ground plane 65 and conductive ground vias 67 extending through the substrate 62 to electrically connect the finite ground planes to the opposed ground plane.

As shown in FIG. 3A and FIG. 3B, the connector 80 is disposed between the lower and upper GCPW substrates such that the center pin 82 is aligned with the respective center conductor strips 54 and 64. FIG. 3B shows the assembled configuration of the substrates 52, 62 and the coaxial connector 80, wherein the electrical contact is made through pressure contact.

The alignment of the vertically attached coaxial center pin 82 to the GCPW center strip is important to the performance of the transition. The center axis of the coaxial pin should be lined up to the center of the GCPW center strip. The end of the GCPW center strip should be lined up to the edge of the coaxial center pin. To compensate for physical misalignment in the lateral direction, the coaxial center pin diameter is smaller than the width of the GCPW center conductor trace. The outer diameter of the dielectric spacer element 84, with an exemplary dielectric constant of 2.6, is designed for 50 ohm transmission line impedance in this exemplary embodiment for the initially chosen pin diameter, and is physically greater than the total GCPW spacing "S" between the ground plane strip 56 and 58, and between ground plane strips 66 and 68. The resulting RF discontinuity, associated with the dimension differences in the two corresponding transmission lines, is small and can be easily compensated by proper adjustment of the GCPW dimension prior to assembly. For example, the parasitic susceptance of the vertical TEM interconnect is typically capacitive. This capacitive junction can be easily compensated by adding some inductance. This is done by increasing the gaps of the GCPW line in the region closest to the junction.

To ensure good solderless DC continuity between the modified coaxial connector 80 and the GCPW line elements, a thin sheet of anisotropically conductive elastomer can be placed between the modified coaxial connector 80 and the GCPW line. Because anisotropically conductive elastomers are conductive only in the direction normal to the board faces, the corresponding elements of the coaxial connector and the GCPW are electrically connected. However, the transmission lines' center conductors and outer ground shields remain electrically isolated. Examples of anisotropically conductive elastomers include the ECPI films marketed by AT&T.

Figure 4:
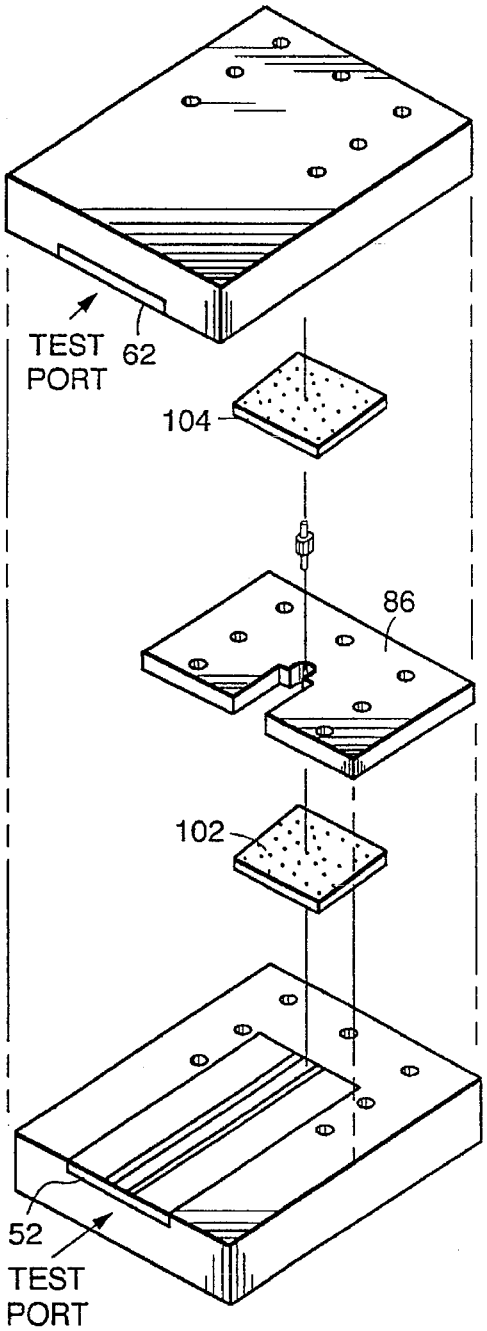
FIG. 4 is an exploded isometric view of an alternate embodiment of a vertical, right angle transition between stacked substrates carrying GCPW transmission lines in accordance with the invention, and employing anisotropically conductive sheets between the connector surfaces and GCPW surfaces.
Figure 5B:
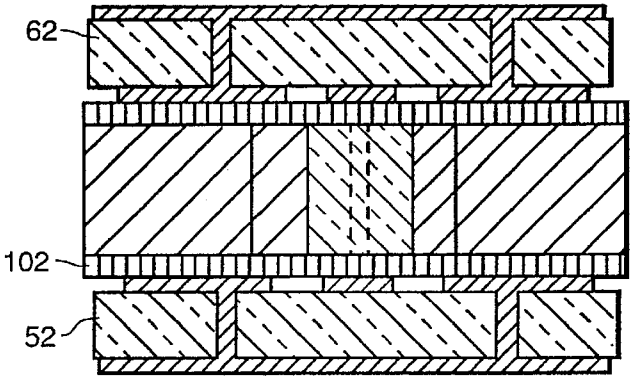
FIG. 5B is a simplified end view of the stacked substrate assembly of FIG. 4, showing the configuration after assembly.
Figure 5A:
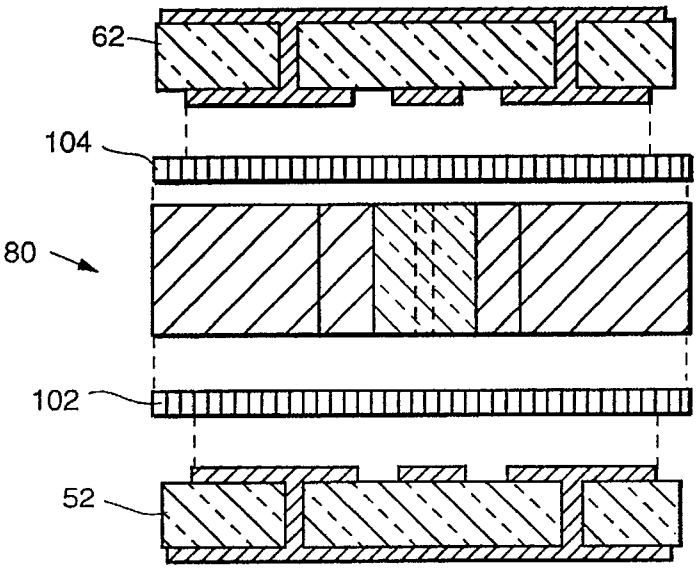
FIG. 5A is a simplified exploded end view of the stacked substrate assembly of FIG. 4, illustrating the substrates and modified coaxial connector prior to assembly.

FIGS. 4 and 5A–5B illustrate an alternate embodiment of a transition between stacked GCPW substrates which includes the thin sheets of the anisotropically conductive elastomer. This embodiment is identical to that of FIGS. 1–3, except that the sheets 102, 104 of the elastomer material are added. The sheet 102 is sandwiched between the lower surface of the plate 86 and the GCPW line elements formed on the surface of the substrate 52. Similarly, the sheet 104 is sandwiched between the upper surface of the plate 86 and the GCPW line elements formed on the surface of the substrate 62. The end views of FIGS. 5A and 5B illustrate the placement of the elastomer material sheets 102, 104, between the respective surfaces of the plate 86 and the GCPW elements on the surfaces of the substrates 52, 62. FIG. 5A is an exploded view showing the substrates 52, 62, the sheets 102, 104 and the coaxial connector 80 before assembly. FIG. 5B shows these elements after assembly, using pressure contacts. The use of the anisotropically conductive sheets or films produces a solderless interconnect that is reliable, easy to assemble and easy to repair.

Figure 7:
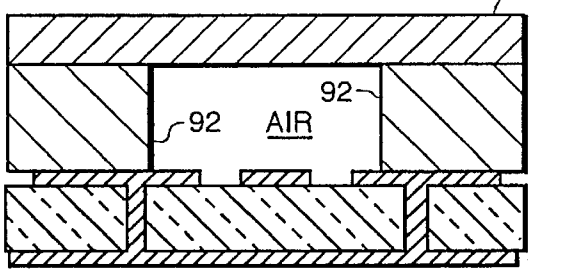
FIG. 7 is an end view of a modified GCPW line with finite top ground planes, via ground connections, and with upper sidewalls formed in the connector region in accordance with the invention.
Figure 6:
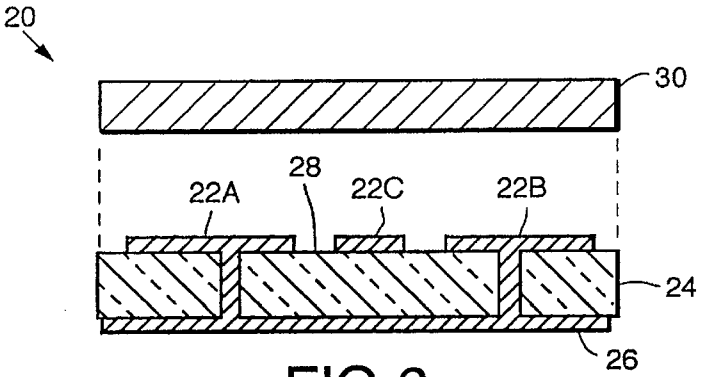
FIG.6 (PRIOR ART)
FIG. 6 shows a conventional GCPW line, without upper sidewall shielding.

A further aspect of the invention is that, with the modified coaxial connector 80 in place, the plate 86 provides upper sidewall metal shielding, indicated at 92 (FIG. 2B) for the GCPW in the area adjacent the connector. This is different from conventional GCPW, which has no upper sidewall shields. FIG. 6 shows a conventional GCPW 20 with finite upper ground planes 22A, 22B, center strip 22C, via ground connections 24 between the lower ground plane 26 and the upper ground planes, substrate 28 and top cover 30. There is no side wall shielding for the conventional GCPW line. When the outer shield of the modified coaxial connector 80 contacts the two outer GCPW strips, the GCPW transmission line becomes modified from the conventional GCPW line in the area before the RF signal is routed vertically into the coaxial connector 80. This modified GCPW line formed in accordance with the invention is illustrated in FIG. 7, an end view of a GCPW line with sidewalls 92. In this exemplary case, a top ground plane 30 is included, although in the case of a connector 80 between sandwiched substrates, the top ground plane would be replaced by the top substrate with its GCPW line.

An alternative embodiment of a modified coaxial connector 80' in accordance with the invention is shown in FIG. 8. This view is similar to FIG. 3B, i.e. a cross-sectional view. This view illustrates the embodiment in which the outer shielding of the coaxial interconnect is closed in the center portion of the interconnect, i.e. around the full 360 degree circumference, with, in this exemplary embodiment, approximately 60 degree openings only at the two ends of the coaxial connector which contact the GCPW lines. Particularly, the plate 86' forms a full 360 degree shielding about the center pin 82, except at the ends of the connector which have relieved areas 90A and 90B, respectively. The relieved areas extend through a circumferential sector, sufficiently large that the metal shielding does not contact the center conductor strips 54 and 64 of the GCPW transmission lines. FIG. 9 shows a similar alternate embodiment, employing the anisotropically conductive films 102 and 104 to produce a solderless interconnect that is reliable, easy to assemble and easy to repair. Here again, the plate 86' has cutouts to define the relieved areas 90A and 90B at the ends of the connector.

The center conductor pin 82 of the modified coaxial connector 80 can be fabricated of a solid piece of metal, or alternatively can be realized by densely packing thin wire into the pin hole formed in the supporting dielectric 84 to form a compressible conductor. FIG. 10A illustrates one possible form of a compressible conductor pin 82' in a bore formed in the dielectric member 84. The conductor is a compressible mass of thin wire densely packed into the respective opening in the dielectric. In an exemplary implementation, the diameter of the wire is on the order of 0.001 to 0.002 inch. Moreover, the conductor extends a short distance from the end edges of the dielectric 84 to form compressible, springy button contacts 82A" and 82B". An exemplary range of this distance is 3–10 mils. These button contacts can then be employed to make electrical contact with the GCPW conductor strips extending at right angles to the axis of the coaxial connector 80. The electrical connections are low loss connections at microwave frequencies. FIG. 10B shows an alternate form of pin structure 82'", comprising a solid conductor portion 82C'" and two compressible portions 82A'" and 82B'" at the extremities of the solid portion. The compressible portions are formed of thin metal wire densely packed into the opening formed in the dielectric 84, in the same manner as the compressible conductor 82" of FIG. 10A.

A potential use for the invention is to carry RF signals between vertically stacked MIC substrates within an RF module package for an active array antenna system, providing the advantages of low loss, minimal space requirements, low cost, single mode operation, and a vertical transition. Stacked RF substrates can be employed in T/R modules, receiver/exciters, communication subsystems, and other microwave circuitry. Such circuitry is found in radar systems, satellites, microwave automobile electronics, missile systems, and other applications where minimization of size is important, such as cellular telephones.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. An RF right angle transition for Grounded Coplanar Waveguide (GCPW) transmission line, comprising:

a dielectric substrate with a GCPW line, wherein a center conductor strip and opposed finite ground conductor strips are formed on a first substrate surface and a conductive ground plane is formed on a second substrate surface; and a modified coaxial connector structure, comprising a center conductor pin, a dielectric support element surrounding the pin, and outer conductive shielding surrounding a portion of a periphery of the dielectric support element, an area of said periphery being free of conductive shielding, said connector structure disposed transversely to said GCPW center conductor strip such that an end of said coaxial center pin is in contact with said center conductor strip, and said coaxial outer shielding is in contact with said first and second finite ground strips, wherein said shielding does not contact said center conductor strip due to said area of said periphery being free of shielding, said outer shielding is defined by a conductive plate member having an opening formed therein to receive said dielectric element and said in said opening having a generally cylindrical configuration with an area in which the plate member is further open adjacent the cylindrical configuration to define said area of said periphery being free of shielding, and wherein said shielding provides a ground return between the coaxial connector structure and said GCPW line without shorting said GCPW center conductor strip.

2. The transition of claim 1 wherein said plate member further comprises side walls defined by said open area of said periphery being free of shielding, said side walls providing upper side wall shielding for said GCPW transmission line.

3. The transition of claim 1 wherein said pin makes contact with said GCPW center conductor strip at an end of said conductor strip.

4. The transition of claim 2 wherein said pin is centered with respect to a lateral extent of said center conductor strip.

5. The transition of claim 1 further comprising a layer of anisotropically conductive elastomer material placed between said modified coaxial connector structure and said GCPW strips, said material conductive only in the direction normal to said surface of said substrate, wherein said center conductor strip remains electrically isolated from said coaxial outer shielding.

6. The transition of claim 1 wherein said connection between said modified coaxial connector structure and said GCPW line is solderless.

7. The transition of claim 1 wherein said area of said coaxial outer shielding extends through an angular extent of the periphery of the coaxial shielding, said angular extent in the range of about 60 degrees to about 120 degrees.

8. The transition of claim 1 wherein said connector structure has first and second ends, said first end disposed adjacent said GCPW line, said area of said periphery being free of shielding is defined at said first end of the connector structure, and wherein the shielding surrounds the outer periphery of the dielectric support element at a region intermediate said first and second ends.

9. The transition of claim 1 wherein said center conductor pin comprises a compressible conductor member formed of thin metal densely packed within an opening formed in said dielectric support element, said compressible conductor member including a first end protruding from a first end of said opening to form a first compressible contact at said first opening end.

10. A stacked assembly of substrates with Grounded Coplanar Waveguide (GCPW) transmission lines with RF interconnection provided between the substrates, the assembly comprising:

a first dielectric substrate with a first GCPW line, wherein a first center conductor strip and opposed first and second finite ground conductor strips are formed on a first substrate surface and a first conductive ground plane is formed on a second substrate surface;

a second dielectric substrate with a second GCPW line, wherein a second center conductor strip and opposed third and fourth finite ground conductor strips are formed on a first substrate surface of said second substrate and a second conductive ground plane is formed on a second substrate surface of said second substrate;

said first and second substrates arranged in a stacked, spaced configuration; and a modified coaxial connector structure for providing a solderless right angle interconnect between said first and second GCPW lines, said connector structure disposed between said first and second substrates, and comprising a center conductor pin, a dielectric support element surrounding the pin, and outer conductive shielding surrounding a portion of a periphery of the dielectric support element, an area of said periphery being free of conductive shielding, said connector structure disposed transversely to the respective first and second GCPW center conductor strips such that a first end of said coaxial center pin is in contact with said first center conductor strip, a second end of said pin is in contact with said second center conductor strip, and said coaxial outer shielding is in contact with said first and second finite ground strips of said first GCPW line and in contact with said third and fourth finite ground strips of said second GCPW line, and wherein said shielding does not contact said center conductor strips due to said area of said periphery being free of shielding, and said outer shielding is defined by a conductive plate member having an opening formed therein to receive said dielectric element and said pin, said opening having a generally cylindrical configuration with an area in which the plate member is further open adjacent the cylindrical configuration to define said area of said periphery being free of shielding;

wherein said shielding provides a ground return between the coaxial connector structure and said GCPW lines without shorting said GCPW center conductor strip.

11. The assembly of claim 10 wherein said plate member comprises side walls defined by said area of said periphery being free of shielding, said side walls providing upper side wall shielding for said GCPW transmission lines.

12. The assembly of claim 10 wherein said pin makes contact with said first and second GCPW center conductor strip at ends of said conductor strips.

13. The assembly of claim 10 wherein said pin is centered with respect to a lateral extent of said center conductor strips.

14. The assembly of claim 10 further comprising a first layer of anisotropically conductive elastomer material placed between said modified coaxial connector structure and said first GCPW line strips, and a second layer of anisotropically conductive elastomer material placed between said connector structure and said second GCPW line strips, said material conductive only in the direction normal to said surface of said substrate, wherein said center conductor strips remain electrically isolated from said coaxial outer shielding.

15. The assembly of claim 10 wherein said area of said coaxial outer shielding extends through an angular extent of the periphery of the coaxial shielding, said angular extent in the range of about 60 degrees to about 120 degrees.

16. The assembly of claim 10 wherein said connector structure has first and second ends, said first end disposed adjacent said GCPW line, said area of said periphery being free of shielding is defined at said first end of the connector structure, and wherein the shielding surrounds the outer periphery of the dielectric support element at a region intermediate said first and second ends.

17. The assembly of claim 10 wherein said center conductor pin comprises a compressible conductor member formed of thin metal densely packed within an opening formed in said dielectric support element, said compressible conductor member including a first end protruding from a first end of said opening to form a first compressible contact at said first opening end.

18. An RF right angle transition for Grounded Coplanar Waveguide (GCPW) transmission line, comprising:

a dielectric substrate with a GCPW line, wherein a center conductor strip and opposed finite ground conductor strips are formed on a first substrate surface and a conductive ground plane is formed on a second substrate surface; and a modified coaxial connector structure, comprising a center conductor pin, a dielectric support element surrounding the pin, and outer conductive shielding surrounding a portion of a periphery of the dielectric support element, an area of said periphery being free of conductive shielding, said connector structure disposed transversely to said GCPW center conductor strip such that an end of said coaxial center pin is in contact with said center conductor strip, and said coaxial outer shielding is in contact with said first and second finite ground strips, wherein said shielding does not contact said center conductor strip due to said area of said periphery being free of shielding, said area of said coaxial outer shielding extends through an angular extent of the periphery of the coaxial shielding, said angular extent in the range of about 60 degrees to about 120 degrees, and wherein said shielding provides a ground return between the coaxial connector structure and said GCPW line without shorting said GCPW center conductor strip.

19. An RF right angle transition for Grounded Coplanar Waveguide (GCPW) transmission line, comprising:

a dielectric substrate with a GCPW line, wherein a center conductor strip and opposed finite ground conductor strips are formed on a first substrate surface and a conductive ground plane is formed on a second substrate surface; and a modified coaxial connector structure, comprising a center conductor pin, a dielectric support element surrounding the pin, and outer conductive shielding surrounding a portion of a periphery of the dielectric support element, an area of said periphery being free of conductive shielding, said connector structure disposed transversely to said GCPW center conductor strip such that an end of said coaxial center pin is in contact with said center conductor strip, and said coaxial outer shielding is in contact with said first and second finite ground strips, wherein said shielding does not contact said center conductor strip due to said area of said periphery being free of shielding, said shielding provides a ground return between the coaxial connector structure and said GCPW line without shorting said GCPW center conductor strip, and wherein said connector structure has first and second ends, said first end disposed adjacent said GCPW line, said area of said periphery being free of shielding is defined at said first end of the connector structure, the shielding surrounding the outer periphery of the dielectric support element at a region intermediate said first and second ends.

20. A stacked assembly of substrates with Grounded Coplanar Waveguide (GCPW) transmission lines with RF interconnection provided between the substrates, the assembly comprising;

a first dielectric substrate with a first GCPW line, wherein a first center conductor strip and opposed first and second finite ground conductor strips are formed on a first substrate surface and a first conductive ground plane is formed on a second substrate surface;

a second dielectric substrate with a second GCPW line, wherein a second center conductor strip and opposed third and fourth finite ground conductor strips are formed on a first substrate surface of said second substrate and a second conductive ground plane is formed on a second substrate surface of said second substrate;

said first and second substrates arranged in a stacked, spaced configuration; and a modified coaxial connector structure for providing a solderless right angle interconnect between said first and second GCPW lines, said connector structure disposed between said first and second substrates, and comprising a center conductor pin, a dielectric support element surrounding the pin, and outer conductive shielding surrounding a portion of a periphery of the dielectric support element, an area of said periphery being free of conductive shielding, said connector structure disposed transversely to the respective first and second GCPW center conductor strips such that a first end of said coaxial center pin is in contact with said first center conductor strip, a second end of said pin is in contact with said second center conductor strip, and said coaxial outer shielding is in contact with said first and second finite ground strips of said first GCPW line and in contact with said third and fourth finite ground strips of said second GCPW line, and wherein said shielding does not contact said center conductor strips due to said area of said periphery being free of shielding, said shielding provides a ground return between the coaxial connector structure and said GCPW lines without shorting said GCPW center conductor strip, and wherein said area of said coaxial outer shielding extends through an angular extent of the periphery of the coaxial shielding, said angular extent in the range of about 60 degrees to about 120 degrees.

21. A stacked assembly of substrates with Grounded Coplanar Waveguide (GCPW) transmission lines with RF interconnection provided between the substrates, the assembly comprising:

a first dielectric substrate with a first GCPW line, wherein a first center conductor strip and opposed first and second finite ground conductor strips are formed on a first substrate surface and a first conductive ground plane is formed on a second substrate surface;

a second dielectric substrate with a second GCPW line, wherein a second center conductor strip and opposed third and fourth finite ground conductor strips are formed on a first substrate surface of said second substrate and a second conductive ground plane is formed on a second substrate surface of said second substrate;

said first and second substrates arranged in a stacked, spaced configuration; and a modified coaxial connector structure for providing a solderless right angle interconnect between said first and second GCPW lines, said connector structure disposed between said first and second substrates, and comprising a center conductor pin, a dielectric support element surrounding the pin, and outer conductive shielding surrounding a portion of a periphery of the dielectric support element, an area of said periphery being free of conductive shielding, said connector structure disposed transversely to the respective first and second GCPW center conductor strips such that a first end of said coaxial center pin is in contact with said first center conductor strip, a second end of said pin is in contact with said second center conductor strip, and said coaxial outer shielding is in contact with said first and second finite ground strips of said first GCPW line and in contact with said third and fourth finite ground strips of said second GCPW line, and wherein said shielding does not contact said center conductor strips due to said area of said periphery being free of shielding, said shielding providing a ground return between the coaxial connector structure and said GCPW lines without shorting said GCPW center conductor strip, and wherein said connector structure has first and second ends, said first end disposed adjacent said GCPW line, said area of said periphery being free of shielding is defined at said first end of the connector structure, the shielding surrounding the outer periphery of the dielectric support element at a region intermediate said first and second ends.

* * * * *